US010150542B2

(12) United States Patent
Izume

(10) Patent No.: US 10,150,542 B2
(45) Date of Patent: Dec. 11, 2018

(54) PLANING BOAT AND METHOD FOR MANUFACTURING THE SAME

(71) Applicant: Masayuki Izume, Kyoto (JP)

(72) Inventor: Masayuki Izume, Kyoto (JP)

(73) Assignee: Masayuki Izume, Kyoto-shi (JP)

( * ) Notice: Subject to any disclaimer, the term of this patent is extended or adjusted under 35 U.S.C. 154(b) by 0 days.

(21) Appl. No.: 15/526,335

(22) PCT Filed: Nov. 12, 2015

(86) PCT No.: PCT/JP2015/081811

§ 371 (c)(1),
(2) Date: May 12, 2017

(87) PCT Pub. No.: WO2016/080272

PCT Pub. Date: May 26, 2016

(65) Prior Publication Data

US 2017/0327193 A1 Nov. 16, 2017

(30) Foreign Application Priority Data

Nov. 19, 2014 (JP) ..... 2014-234705

(51) Int. Cl.

| | |
|---|---|
| ***B63B 43/06*** | (2006.01) |
| ***B63B 1/18*** | (2006.01) |
| ***B63B 9/04*** | (2006.01) |
| ***B63B 39/02*** | (2006.01) |
| *B63B 43/14* | (2006.01) |
| *B63B 59/02* | (2006.01) |
| *B63B 3/26* | (2006.01) |

(52) U.S. Cl.

CPC ..... *B63B 43/06* (2013.01); *B63B 1/18* (2013.01); *B63B 9/04* (2013.01); *B63B 39/02* (2013.01);

(Continued)

(58) Field of Classification Search

CPC .. B63B 1/00; B63B 1/04; B63B 1/042; B63B 1/18; B63B 1/34; B63B 1/38;

(Continued)

(56) References Cited

U.S. PATENT DOCUMENTS 3,085,535 A 4/1963 Hunt
4,528,927 A * 7/1985 Iizuka ..... B63B 39/03 114/125

(Continued)

FOREIGN PATENT DOCUMENTS

EP 0244368 A1 11/1987
JP 1-95991 4/1989

(Continued)

OTHER PUBLICATIONS

International Search Report for corresponding International Application No. PCT/JP2015/081811, dated Jan. 26, 2016.

(Continued)

*Primary Examiner* — Lars A Olson

(74) *Attorney, Agent, or Firm* — Mori & Ward, LLP

(57) ABSTRACT

A planning boat includes at least one tank provided on a bottom of the boat. The tank has, at a stern side, a wall through which a through hole is provided below a waterline. A hull of the planning boat includes a bottom plate that forms the bottom of the boat, right and left side plates that form sides of the boat and a bow, a transom plate that forms a stern, and a plurality of longitudinal vertical plates. The plurality of longitudinal vertical plates each extend between the transom plate and forward portions of the side plates along a sailing direction and each have a lower surface that is fixed to an upper surface of the bottom plate. The tank is formed by using the pair of longitudinal vertical plates of the existing planning boat.

6 Claims, 6 Drawing Sheets

(52) U.S. Cl.
CPC ..... *B63B 43/14* (2013.01); *B63B 59/02* (2013.01); *B63B 2003/265* (2013.01)

(58) Field of Classification Search
CPC ..... B63B 35/73; B63B 35/81; B63B 35/815; B63B 35/85; B63B 39/03; B63B 43/06; B63B 43/14; B63B 39/02; B63B 9/04; B63B 59/02
USPC ..... 114/121, 125
See application file for complete search history.

(56) References Cited

U.S. PATENT DOCUMENTS

| | | | | |
|---|---|---|---|---|
| 5,228,407 | A | 7/1993 | Cummer et al. | |
| 6,234,099 | B1 * | 5/2001 | Jessen | B63B 1/32 114/121 |
| 2011/0107954 | A1 | 5/2011 | Schaefer, Jr. | |

FOREIGN PATENT DOCUMENTS

| | | |
|---|---|---|
| JP | 01-212691 | 8/1989 |
| JP | 8-150990 | 6/1996 |
| JP | 11-049093 | 2/1999 |
| JP | 2001-287693 | 10/2001 |
| JP | 2004-58772 | 2/2004 |

OTHER PUBLICATIONS

Extended European Search Report for corresponding EP Application No. 15860582.4-1015, dated May 30, 2018.

* cited by examiner

PLANING BOAT AND METHOD FOR MANUFACTURING THE SAME

TECHNICAL FIELD

The present invention relates to a planing boat, and more particularly, to a planing boat that is prevented from rocking when moored.

BACKGROUND ART

Small-sized planing boats such as various types of fishing boats and pleasure boats are used for fishing, while they are moored on a water surface of the sea or lakes. Under the circumstances, preventing the boat from rocking when moored has been an issue to address. Patent Literature 1 discloses a hull stabilizing mechanism (anti-rocking device) including a rudder blade and a rudder blade moving mechanism, in which placing the rudder blade into water prevents the boat from rocking while removing the rudder blade from the water when sailing prevents the rudder blade from producing sailing resistance.

CITATION LIST

Patent Literature

Patent Literature 1: Japanese Unexamined Patent Application Publication No. 2004-58772

SUMMARY OF INVENTION

Technical Problem

To prevent the boat from rocking when moored, it is necessary to prevent the anti-rocking device from acting as an impediment to the sailing of the boat. In addition, it is desired that an operation to remove the impediment to the sailing is trouble-free.

According to the anti-rocking device described in Patent Literature 1, when sailing, the rudder blade is removed from the water using the rudder blade moving mechanism, whereby the rudder blade is prevented from acting as an impediment to the sailing of the boat. There has been a problem in Patent Literature 1 that the operation to remove the impediment to the sailing is troublesome.

An object of the present invention is to provide a planing boat in which an anti-rocking device thereof is prevented from acting as an impediment to the sailing of the boat and in which an operation to remove the impediment to the sailing is trouble-free.

Solution to Problem

A planing boat in accordance with the present invention includes a tank provided on a bottom of the boat. The tank has, at a stern side, a wall through which a through hole is provided below a waterline.

Since the through hole formed through a stern-side wall of the tank is located below the waterline (i.e., a line where the hull floating on the still water meets the surface of the water), water (seawater or fresh water) flows into the inside of the tank from the outside of the hull when the boat is moored, whereby the total weight of the boat increases and the center of gravity is lowered. The boat is thus prevented from rocking when moored.

Although the tank is, for example, made of fiberglass reinforced plastic (FRP), the material is not limited thereto. The tank preferably has the shape of an approximately rectangular parallelepiped, which extends over an approximately entire length from the stern to the bow.

When the planing boat starts sailing and the sailing speed exceeds a certain value, the bow rises above the surface of the water, and the boat starts pushing water away at an area behind the stern. In this situation, since the tank is inclined upward toward the bow side, and no water exists outside around the stern, water in the tank is discharged to the outside of the hull. Therefore, the boat sails at high speed with the tank emptied. The sailing resistance associated with the provision of the tank increases only by an amount corresponding to an increase of the empty tank, which is equivalent to the case of a boat that does not include an anti-rocking device. As such, the anti-rocking device is prevented from acting as an impediment to the sailing of the boat.

The introduction of the water from outside of the hull into the tank when the boat is moored, and the discharge of the water from inside of the tank to the outside of the hull at the sailing are performed associated with the stoppage and the sailing of the boat, respectively, and therefore an operation to prevent the boat from acting as an impediment to the sailing is trouble-free.

It is preferable that a communicating tube for providing communication between an inside and an outside of the tank is provided at a bow end portion of a top plate of the tank.

This facilitates the introduction of the water when the water is introduced from the outside of the hull into the inside of the tank since the pressure in the tank at the bow side is maintained at atmospheric pressure, and facilitates the discharge of the water when the water is discharged from within the tank to a space outside the hull since the pressure in the tank at the bow side is maintained at atmospheric pressure.

It is preferable that a lid that opens/closes the through hole is provided.

With this structure, in a case where rocking raises no problem, such as a case where the planing boat temporarily stops sailing and a case where the boat is moored at a port with no attendant, the through hole may be closed using a lid to prevent the water from flowing into the tank. This allows the boat to be lightweight leading to smooth acceleration when the boat starts sailing again, which results in energy saving. In addition, preferably, the lid may be opened/closed through an operation of a handle, a switch, and other components from inside the boat.

It is preferable that the hull includes: a bottom plate that forms the bottom of the boat; right and left side plates that form sides of the boat and a bow; a transom plate that forms a stern; and a plurality of longitudinal vertical plates each extending between the transom plate and forward portions of the side plates along a sailing direction and each having a lower surface that is fixed to an upper surface of the bottom plate, and the top plate is provided between upper portions of one pair of the longitudinal vertical plates whereby the tank is formed by the pair of longitudinal vertical plates, the top plate, a part of the bottom plate, a part of the transom plate, and a part of each side plate, and the through hole is formed through the transom plate.

This structure allows the longitudinal vertical plates and the top plate to reinforce the boat, and secures the strength of the tank in itself.

It is preferable that the longitudinal vertical plates that are provided to an existing boat are used, and that additional processes required are only to provide the top plate, to form the through hole, and to provide the communicating tube.

In small-sized boats, which the planing boat in accordance with the present invention is directed to, generally, longitudinal vertical plates are provided, as reinforcing materials, each of which extends from the bow to the stern. Therefore, by using the longitudinal vertical plates that are provided to the existing boat, additional processes only include the provision of the top plate, the formation of the through hole, and the provision of the communicating tube. With this configuration, an anti-rocking device may be easily added to the existing boat.

Materials of the top plate are not particularly limited, but since the hull (and the longitudinal vertical plates) of the boat of this type is made of FRP, when the top plate is also made of FRP, the processing is facilitated.

In some embodiments, an engine is disposed at each of right and left parts of the hull, and a tank is disposed at a center of the hull, or an engine is disposed at a center of the hull, and the tank is disposed in parallel to each of the right and the left of the engine.

For example, four longitudinal vertical plates that are provided to an existing boat are arranged symmetrically in the right and left direction. This example case includes two types of configurations, i.e., a first type in which each of the right and left engines are supported by a pair of longitudinal vertical plates, and a second type in which a center engine is supported by two longitudinal vertical plates disposed at the center side. In the first type, a tank is formed by two longitudinal vertical plates at the center side. In the second type, each of the right and left tanks is formed by the pair of longitudinal vertical plates. In each type, existing longitudinal vertical plates are used to form a tank for preventing the rocking.

Advantageous Effects of Invention

With the planing boat in accordance with the present invention, the introduction of the water from outside of the hull into the tank when the boat is moored, and the discharge of the water from inside of the tank to the outside of the hull at the sailing are performed associated with the stoppage and the sailing of the boat, respectively, whereby the boat is prevented from rocking when moored, and an operation to prevent the boat from acting as an impediment to the sailing is trouble-free.

DESCRIPTION OF EMBODIMENTS

Embodiments of the present invention will now be described with reference to the drawings.

Figure 1:
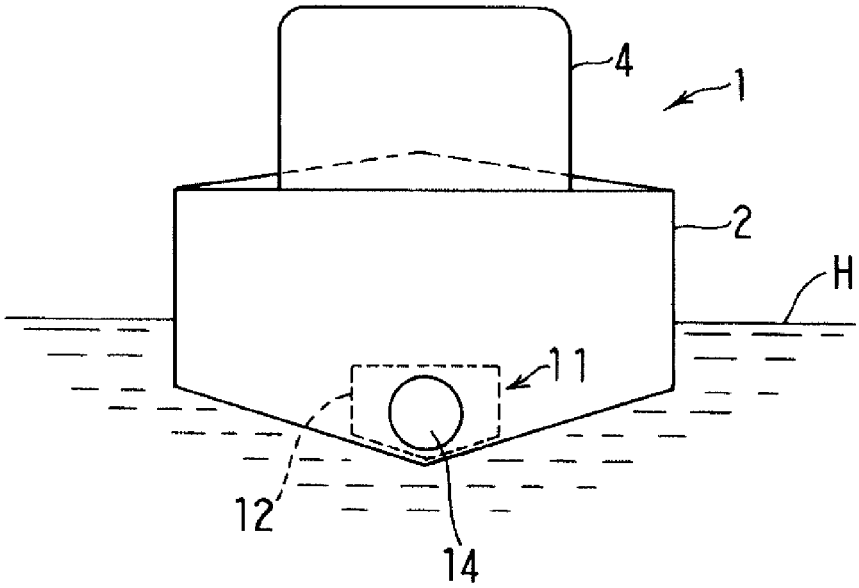
FIG. 1 is a back view of a planing boat, when moored, according to a first embodiment of the present invention.
Figure 2:
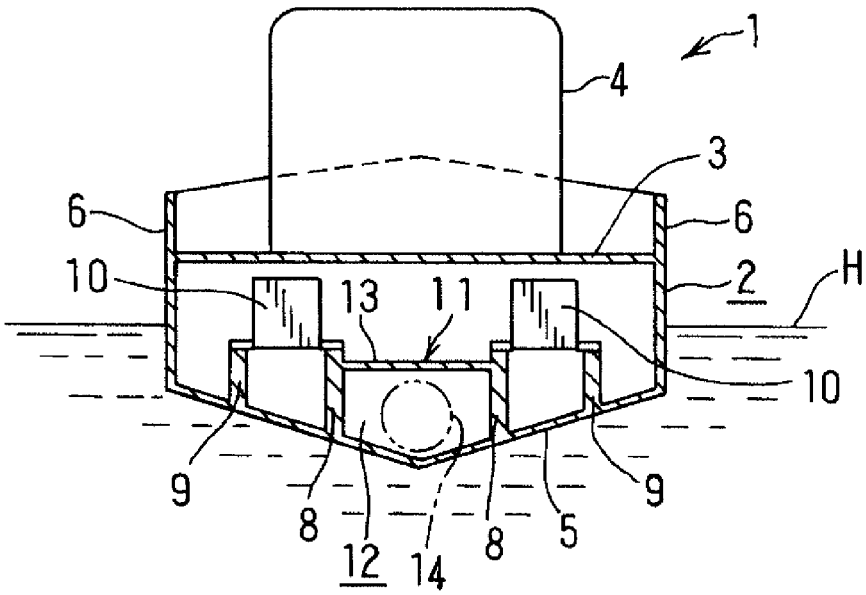
FIG. 2 is a transverse sectional view of the planing boat, when moored, according to the first embodiment.
Figure 3:
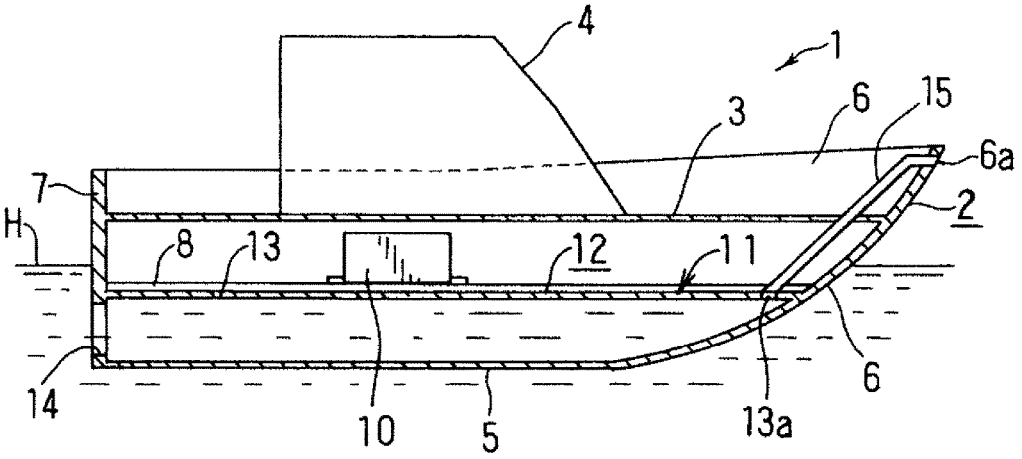
FIG. 3 is a longitudinal sectional view (a cross section along the center line of an anti-rocking device) of the planing boat, when moored, according to the first embodiment.

FIG. 1 to FIG. 3 show a planing boat, when moored, according to a first embodiment of the present invention. A boat (1) includes: a hull (2) made of fiberglass reinforced plastic (FRP); a deck (3) made of FRP and joined to an outer edge of an upper portion of the hull (2); and a cabin (4) provided to project from the deck (3).

The hull (2) includes: a bottom plate (5) that forms the bottom of the boat; right and left side plates (6) that form the sides of the boat and a bow; a transom plate (7) that forms a stern; and four longitudinal vertical plates (8) and (9) each extending between the transom plate (7) and forward portions of the right and left side plates (6) along a sailing direction and each having a lower surface that is fixed to an upper surface of the bottom plate (5).

The four longitudinal vertical plates (8) and (9) are arranged symmetrically in the right and left direction. Between each pair of the longitudinal vertical plates (8) and (9), an engine (10) supported by an engine mount is disposed. The boat (1) thus has two engines disposed at the right and left parts of the boat (1).

The structure described above is the same as that of the conventional planing boat. The planing boat (1) in accordance with the present invention further includes an anti-rocking device (11).

The anti-rocking device (11) has a tank (12) for storing water. Between upper ends of the two longitudinal vertical plates (8), which are arranged to the center, a top plate (13) is laid. The pair of longitudinal vertical plates (8), the top plate (13), a part of the bottom plate (5), a part of the transom plate (7), and a bow end portion of each of the right and left side plates (6) form an enclosed space to constitute the tank (12).

The transom plate (7) has a through hole (14) that allows water (seawater or fresh water) to flow into/out of the tank (12). The through hole (14) is provided below the waterline (i.e., a water surface (H)) on the transom plate (7) (a wall on the stern side of the tank (12)). With this structure, when the boat (1) is moored, the water flows into the tank (12) whereby the tank (12) is filled with water.

As shown in FIG. 3, at the front end portion (bow side) of the tank (12), a communicating tube (15) that allows air to flow in and out of the tank (11) is provided. The communicating tube (15) has one end that is inserted into a through hole (13*a*) formed at a front end portion of the top plate (13) and the other end that is inserted into a through hole (6*a*) formed at a bow end portion of the side plates (6). When the water flows into the tank (12) when the boat is moored, air within the tank (12) escapes through the communicating tube (15) to the outside, whereby the pressure in the tank (12) at the bow side is maintained at atmospheric pressure.

In this manner, the tank (12) is filled with water in a manner such that the water is not hindered from flowing into the tank (12) by air.

The tank (12), the through hole (14), and the communicating tube (15) constitute the anti-rocking device (11). Here, the longitudinal vertical plates (8), the bottom plate (5), the transom plate (7), and the side plates (6) are used to form the tank (12). These plates (8), (5), (7), and (6) are provided to an existing boat. Therefore, to form the anti-rocking device (11), only the processes of placing the top plate (13), forming the through hole (14), and placing the communicating tube (15) are required as additional processes.

Figure 4:
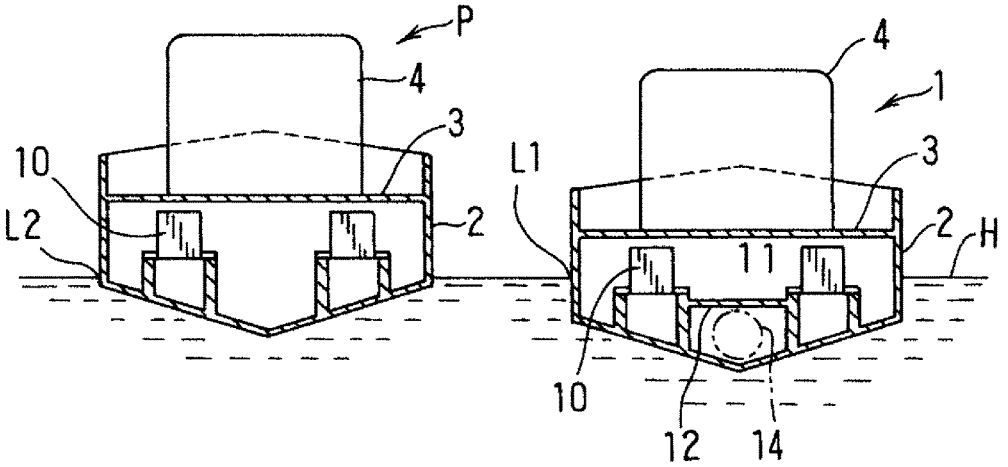
FIG. 4 includes a longitudinal sectional view of a conventional planing boat, when moored, and the longitudinal sectional view of the planing boat, when moored, according to the first embodiment of the present invention, which are shown for comparison.

FIG. 4 shows a boat (1) according to the first embodiment of the present invention shown in FIG. 2 and a conventional boat (P), for comparison. In the boat (1) according to the first embodiment, the tank (12) is filled with water. Therefore, the total weight of the boat (1) increases as compared to the conventional boat (P), the waterline (L1) rises as compared to the waterline (L2) of the conventional boat (P), and the bottom portion of the boat (1) becomes heavier whereby the center of gravity is lowered. As a result, the degree of the rocking of the boat (1), when moored, is less than that of the conventional boat (P).

Figure 5:
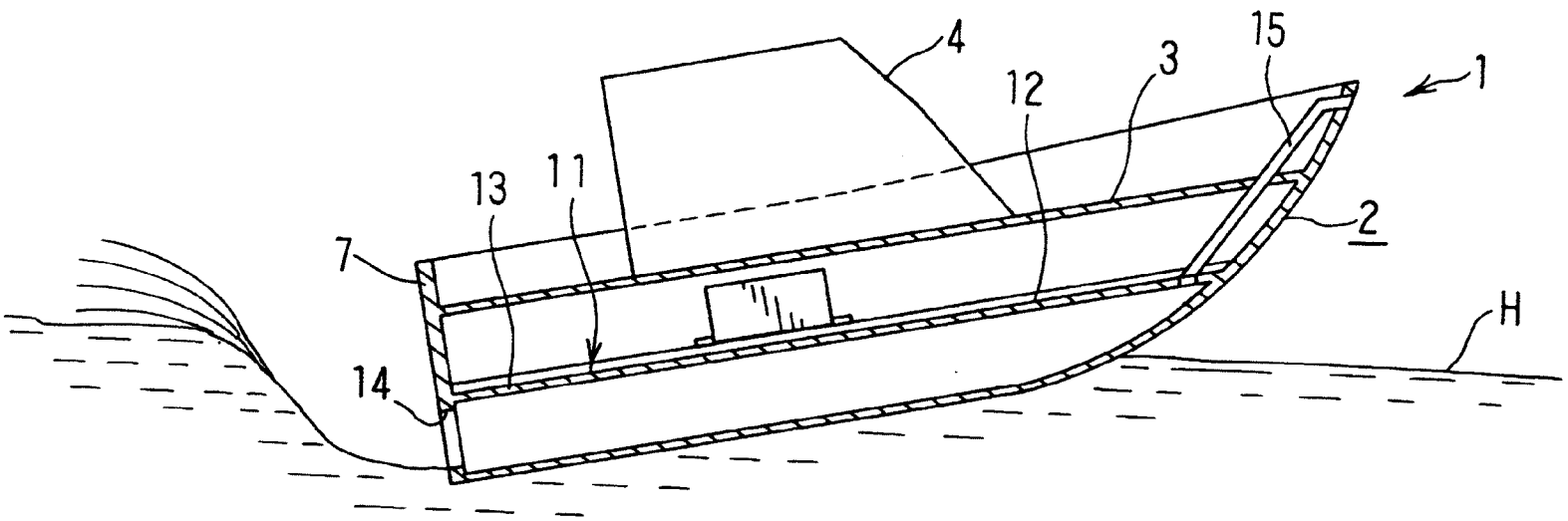
FIG. 5 is a longitudinal sectional view of the planing boat, when sailing, according to the first embodiment.

When the planning boat (1) starts sailing and the sailing speed exceeds a certain value, the bow rises above the surface of the water and the boat starts pushing water away at an area behind the stern, as shown in FIG. 5. In this situation, since the tank (12) that has been horizontal when the boat (1) is moored, is inclined upward toward the bow side, and no water exists outside around the stern, water in the tank (12) is discharged through the through hole (14) formed through the transom plate (7) to the outside the hull (2), whereby the tank (12) is emptied. Since the communicating tube (15) is provided, when the water in the tank (12) is discharged to a space outside the hull (2), the pressure in the tank (12) at the bow side is maintained at atmospheric pressure. This facilitates the water discharge.

In the case where the tank (12) is filled with water at the time of sailing, sailing performance deteriorates due to the increased sailing resistance. However, the tank (12) is empty at the time of sailing whereby there exists no factor of the increase of the sailing resistance. Although the amount corresponding to the increased weight of the top plate (13) and the communicating tube (15) becomes the factor of the sailing resistance as compared to the case where the boat does not include the anti-rocking device, the reinforcement of the hull (2) by the top plate (13) contributes to the improvement of the sailing performance, and the anti-rocking device (11) is prevented from acting as an impediment to the sailing of the boat (1). In addition, to discharge water from the tank (12) (and to introduce water into the tank (12)), no manpower is required, and therefore an operation to remove the impediment to the sailing is trouble-free.

Figure 6:
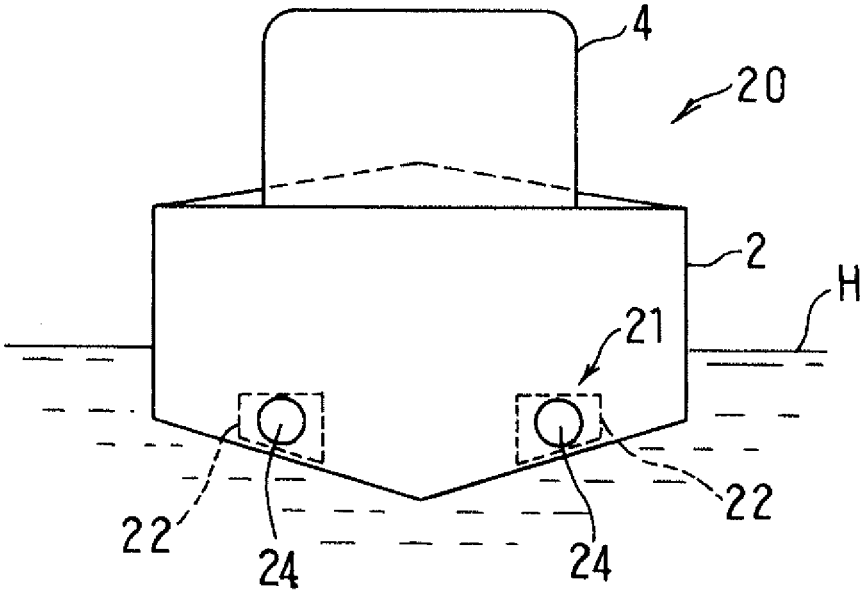
FIG. 6 is a back view of a planing boat, when moored, according to a second embodiment of the present invention.
Figure 7:
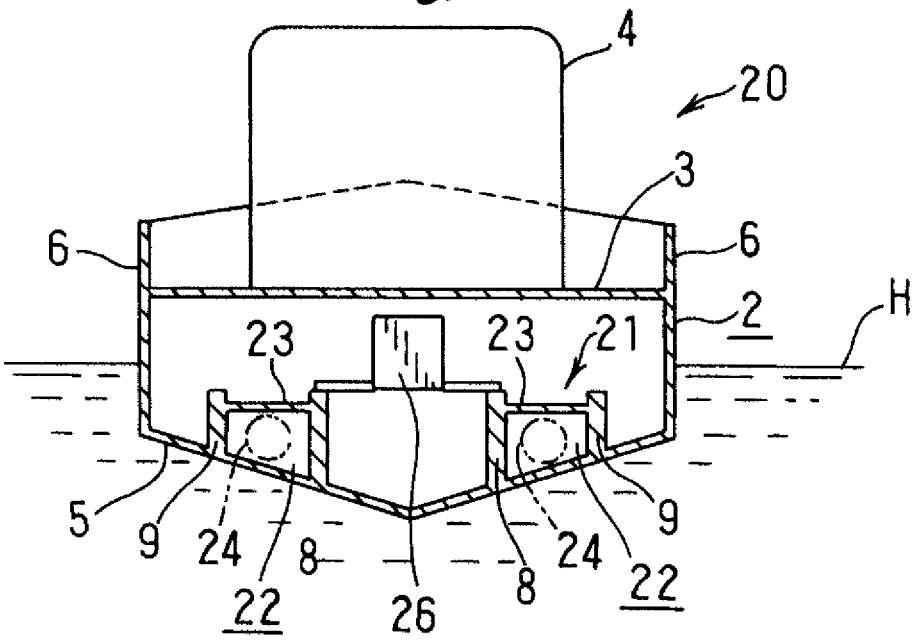
FIG. 7 is a transverse sectional view of the planing boat, when moored, according to the second embodiment.
Figure 8:
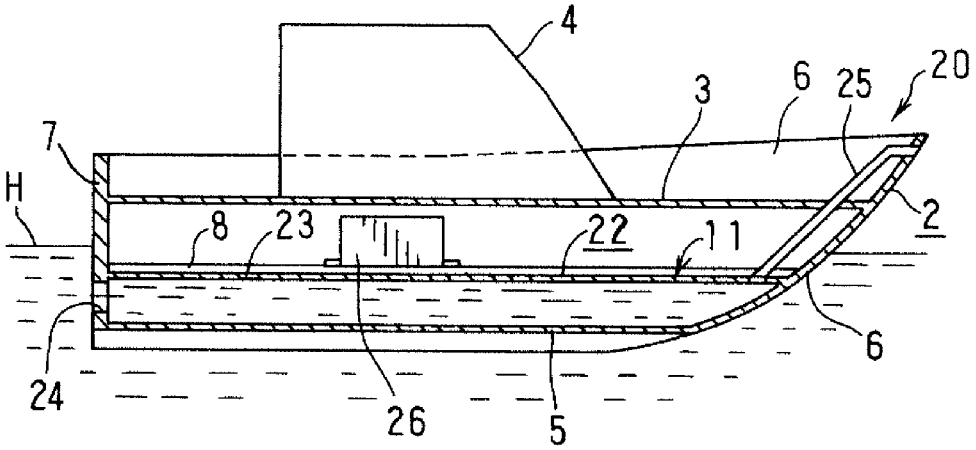
FIG. 8 is a sectional view along the center line of an anti-rocking device of the planing boat, when moored, according to the second embodiment.

FIG. 6 to FIG. 8 show a boat, when moored, according to a second embodiment of the present invention.

A boat (20) according to the second embodiment differs from the boat (1) according to the first embodiment in that an engine (26) is provided at the center in the right and left direction. The shape of the hull (2), including the longitudinal vertical plates (8) and (9), is the same as that of the first embodiment.

The boat (20) as described above has the same structure of the conventional planing boat, but the planing boat (20) in accordance with the present invention further includes an anti-rocking device (21).

The anti-rocking device (21) has right and left tanks (22) for storing water. Between upper ends of each pair of the two longitudinal vertical plates (8) and (9), each pair being provided at the right or left part of the boat (20), a top plate (23) is laid. Each of the two right and left pairs of longitudinal vertical plates (8) and (9), the top plate (23), a part of the bottom plate (5), a part of the transom plate (7), and a bow end portion of each of the right and left side plates (6) form an enclosed space to constitute a tank (22).

The transom plate (7) has a through hole (24) that allows water (seawater or fresh water) to flow into/out of each of the tanks (22). Each through hole (24) is provided below the waterline (i.e., a water surface (H)) on the transom plate (7) (a wall on the stern side of each tank (22)). In addition, at the front end portion (bow side) of each tank (22), a communicating tube (25) that allows air to flow in and out of the tank (11) is provided.

Therefore, to form the anti-rocking device (21), only the processes of placing the top plates (23), forming the through holes (24), and placing the communicating tubes (25) are required as additional processes.

Although drawings corresponding to FIG. 4 and FIG. 5 of the first embodiment are omitted, also in the boat (20) according to the second embodiment, in the same manner as the boat (1) according to the first embodiment, the degree of the rocking of the boat (20) when moored is less than the conventional boat (P), the anti-rocking device (21) is prevented from acting as an impediments to the sailing of the boat (20), and, in addition, an operation to remove the impediment to the sailing is trouble-free.

Figure 9:
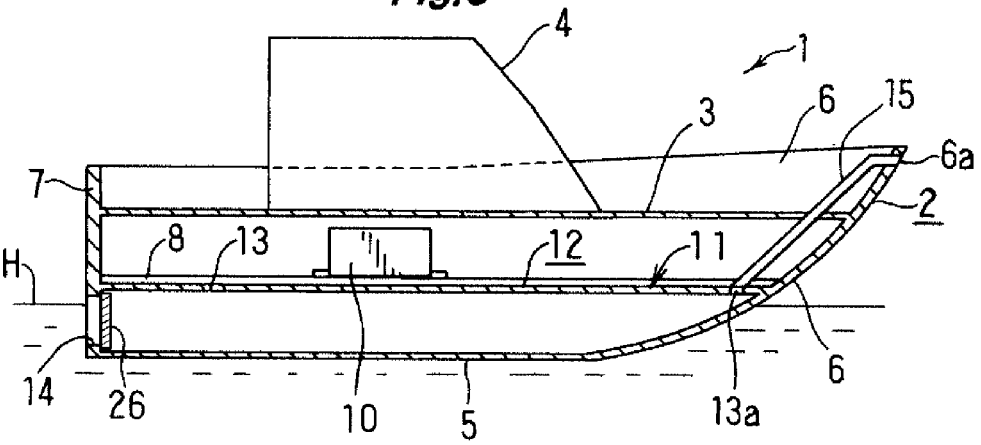
FIG. 9 is a longitudinal sectional view (a cross section along the center line of an anti-rocking device) of a planing boat, when moored, according to a third embodiment.

FIG. 9 shows a boat (when moored) according to a third embodiment of the present invention. The boat according to the third embodiment is configured by further including a lid (26) to the boat according to the first embodiment. In the case where rocking raises no problem, such as a case where the boat temporarily stops sailing and a case where the boat is moored at a port with no attendant, the through hole (14) may be closed using the lid (26) to prevent the water from flowing into the tank (12), when the speed is lowered and before the water flows in through the through hole (14). This prevents the growth of shellfish, algae, and so on within the tank even when the boat is moored over a long period of time, and this allows the boat (1) to be lightweight leading to smooth acceleration when the boat starts sailing again, which results in energy saving.

Figure 10:
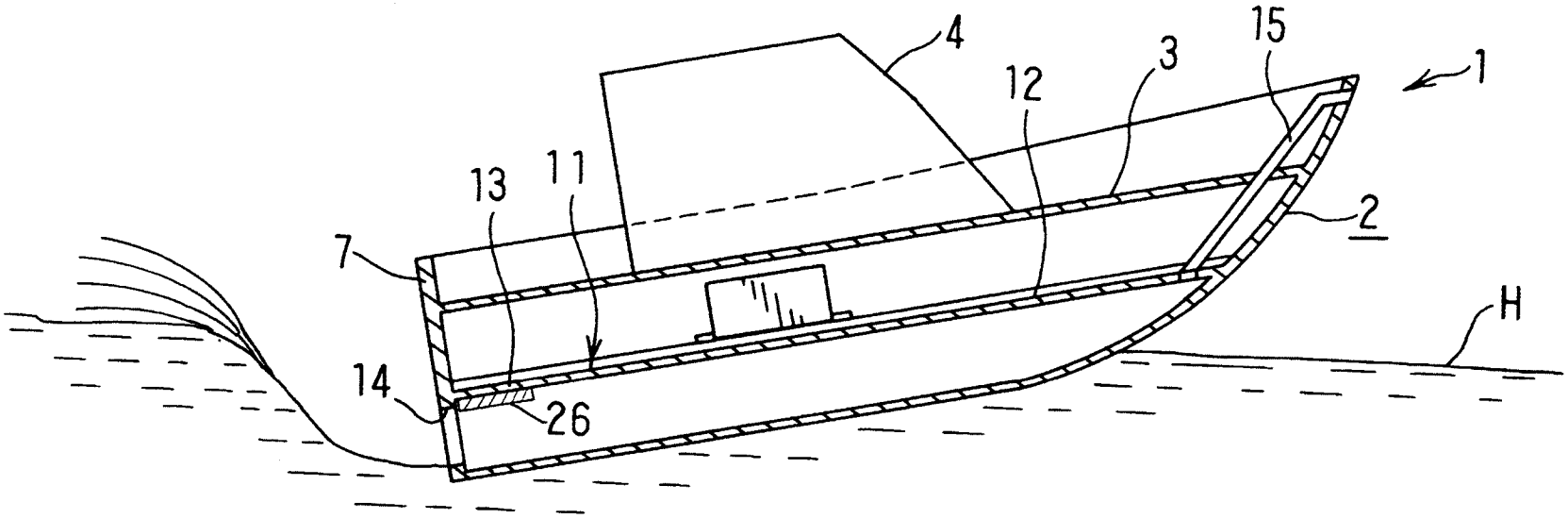
FIG. 10 is a longitudinal sectional view of the planing boat, when sailing, according to the third embodiment.

FIG. 10 shows the boat (during the sailing) according to the third embodiment of the present invention. When the boat starts sailing and the sailing speed exceeds a certain value, the bow rises above the surface of the water and the boat starts pushing water away at an area behind the stern, as shown in FIG. 5. At this time, when the closed lid (26) is opened, the boat continues sailing with no water flowing through the through hole (14) into the tank (12).

In the above embodiments, the longitudinal vertical plates (8) and (9) are not limited to those shown in the drawings, and the tank may be provided by using existing longitudinal vertical plates as appropriate. In addition, when required, any longitudinal material as a separate component may be added for forming the tank.

This international application claims the benefit of priority of Japanese Patent Application No. 2014-234705 filed Nov. 19, 2014 on which the present application is based, and the entire disclosure of which is hereby incorporated by reference.

REFERENCE SIGNS LIST

1: boat
2: hull

5: bottom plate
6: side plate
7: transom plate
8, 9: longitudinal vertical plate
10: engine
11: anti-rocking device
12: tank
13: top plate
14: through hole
15: communicating tube
20: boat
21: anti-rocking device
22: tank
23: top plate
24: through hole
25: communicating tube
26: lid

The invention claimed is:

1. An anti-rocking device in a planing boat, wherein
a hull of the planing boat comprises:
a bottom plate that forms a bottom of the boat;
right and left side plates that form sides of the boat and a bow;
a transom plate that forms a stern; and
a plurality of longitudinal vertical plates each extending between the transom plate and forward portions of the side plates along a sailing direction and each having a lower surface that is fixed to an upper surface of the bottom plate,
a right engine is disposed at a right part of the hull and a left engine is disposed at a left part of the hull,
the plurality of longitudinal vertical plates includes: outside right and left longitudinal vertical plates situated near the right and left side plates, respectively; and inside right and left longitudinal vertical plates situated closer to a center of the hull in relation to the outside right and left longitudinal vertical plates,
the right engine is supported by the outside right longitudinal vertical plate and the inside right longitudinal vertical plate, and the left engine is supported by the outside left longitudinal vertical plate and the inside left longitudinal vertical plate, and
the anti-rocking device comprises: a tank; and a through hole, in which the tank is provided on the bottom of the boat, and the tank has, at a stern side, a wall through which the through hole is provided below a waterline,
wherein a top plate is provided between upper portions of the inside right and left longitudinal vertical plates, the tank being formed by the inside right and left longitudinal vertical plates, the top plate, a part of the bottom plate, a part of the transom plate, and a part of each of the right and left side plates,
wherein the through hole is formed through the transom plate, and
wherein, when the boat is moored, the tank is filled with water and a center of gravity of the planing boat is lowered such that a proportion of a portion of the right and left engines that are below the waterline is greater than the proportion in a state where the tank is empty when the boat sails.

2. The anti-rocking device in the planing boat according to claim 1, wherein
a communicating tube for providing communication between an inside and an outside of the tank is provided at a bow end portion of the top plate of the tank.

3. The anti-rocking device in the planing boat according to claim 1, wherein
a lid that opens/closes the through hole is provided.

4. A method for manufacturing an anti-rocking device in a planing boat, wherein
a hull of the planing boat comprises:
a bottom plate that forms a bottom of the boat;
right and left side plates that form sides of the boat and a bow;
a transom plate that forms a stern; and
a plurality of longitudinal vertical plates each extending between the transom plate and forward portions of the side plates along a sailing direction and each having a lower surface that is fixed to an upper surface of the bottom plate, and
the anti-rocking device includes: a tank; and a through hole, in which the tank is provided on the bottom of the boat, and the tank has, at a stern side, a wall through which the through hole is provided below a waterline,
the method for manufacturing the anti-rocking device comprising:
placing a top plate between upper portions of the existing pair of longitudinal vertical plates to form the tank defined by the existing pair of longitudinal vertical plates, the top plate, a part of the existing bottom plate, a part of the existing transom plate, and a part of each of the existing right and left side plates; and
forming the through hole through the transom plate.

5. The method for manufacturing the anti-rocking device in a planing boat according to claim 4, further comprising:
placing a communicating tube for providing communication between an inside and an outside of the tank at a bow end portion of the top plate of the tank.

6. The method for manufacturing the anti-rocking device in a planing boat according to claim 4, further comprising:
placing a lid that opens/closes the through hole.

* * * * *